US008047128B2

(12) United States Patent
Salvaro

(10) Patent No.: US 8,047,128 B2
(45) Date of Patent: Nov. 1, 2011

(54) VACUUM COOKING APPARATUS FOR HOUSEHOLD USE

(76) Inventor: Marziano Salvaro, Negrar (IT)

( * ) Notice: Subject to any disclaimer, the term of this patent is extended or adjusted under 35 U.S.C. 154(b) by 797 days.

(21) Appl. No.: 12/153,836

(22) Filed: May 27, 2008

(65) Prior Publication Data

US 2008/0302253 A1 Dec. 11, 2008

(30) Foreign Application Priority Data

Jun. 6, 2007 (IT) ..... VR2007A0080

(51) Int. Cl.
*F24C 15/18* (2006.01)
*B65B 31/02* (2006.01)
*A47B 77/12* (2006.01)

(52) U.S. Cl. ..... 99/352; 53/167; 53/512; 62/331; 99/355; 99/357; 99/472; 99/484; 126/369; 165/61; 165/138; 165/918

(58) Field of Classification Search ..... 99/472, 99/484, 352, 355, 357; 53/502, 127, 167, 53/512; 62/331; 126/359; 165/61, 64, 138, 165/918
See application file for complete search history.

(56) References Cited

U.S. PATENT DOCUMENTS

| | | | | | |
|---|---|---|---|---|---|
| 3,353,476 | A * | 11/1967 | Goodman et al. | ..... | 62/331 |
| 3,597,897 | A * | 8/1971 | Gerard | ..... | 53/512 |
| 4,250,959 | A * | 2/1981 | Spasojevic | ..... | 165/61 |
| 4,884,626 | A * | 12/1989 | Filipowski | ..... | 165/64 |
| 5,069,273 | A * | 12/1991 | O'Hearne | ..... | 165/61 |
| 5,520,941 | A * | 5/1996 | Oosterling | ..... | 53/502 |
| 5,964,074 | A * | 10/1999 | Suzuki et al. | ..... | 53/127 |
| 6,148,875 | A * | 11/2000 | Breen | ..... | 141/65 |
| 6,278,098 | B1 * | 8/2001 | Han et al. | ..... | 165/61 |
| 6,941,730 | B2 * | 9/2005 | Schiro' et al. | ..... | 53/512 |
| 7,331,163 | B2 * | 2/2008 | Hau et al. | ..... | 53/512 |
| 2003/0154733 | A1 * | 8/2003 | Ruiz et al. | ..... | 62/331 |

(Continued)

FOREIGN PATENT DOCUMENTS

DE 38 43 040 A1 6/1990

(Continued)

OTHER PUBLICATIONS

Machine translation JP 5-68649, retrieved from http://www4.ipdl.inpit.go.jp/Tokujitu/tjsogodbenk.ipdl, Apr. 22, 2011, 8 pages.*

*Primary Examiner* — Stephen F Gerrity
(74) *Attorney, Agent, or Firm* — Modiano & Associati; Albert Josie; Daniel J. O'Byrne

(57) ABSTRACT

A vacuum cooking apparatus for household use, comprising, on a supporting structure which has a column-like extension, at least one unit for packaging in pouches in vacuum food products to be cooked, at least one unit for cooking the food products arranged in pouches and at least one unit for quick refrigeration of the food products arranged in pouches and cooked, the at least one unit for packaging food products in pouches in vacuum comprising a vacuum packaging machine which is mounted on a drawer-like element which is supported so that it can slide by the supporting structure in order to pass from a retracted position, in which the vacuum packaging machine is arranged within the outer peripheral contour of the supporting structure, to an extracted position, in which the vacuum packaging machine is positioned at least partially outside the supporting structure, and vice versa.

13 Claims, 8 Drawing Sheets

U.S. PATENT DOCUMENTS

| | | | | |
|---|---|---|---|---|
| 2004/0003618 | A1 * | 1/2004 | Kim et al. | 62/331 |
| 2004/0060262 | A1 * | 4/2004 | Harges et al. | 53/512 |

FOREIGN PATENT DOCUMENTS

| | | | | |
|---|---|---|---|---|
| DE | 197 05 779 | C1 | | 5/1998 |
| DE | 203 20 927 | U1 | | 1/2006 |
| EP | 1 433 719 | A | | 6/2004 |
| FR | 2604882 | A1 | * | 4/1988 |
| JP | 59 147937 | A | | 8/1984 |
| JP | 04005920 | A | * | 1/1992 |
| JP | 04114611 | A | * | 4/1992 |
| JP | 05068649 | A | * | 3/1993 |
| WO | WO 02/30240 | A | | 4/2002 |

* cited by examiner

VACUUM COOKING APPARATUS FOR HOUSEHOLD USE

The present invention relates to a vacuum cooking apparatus for household use.

BACKGROUND OF THE INVENTION

A cooking technique, commonly known as "vacuum cooking", is known which consists in practice in vacuum packaging the foods to be cooked in pouches which contain any seasonings and flavoring agents and in subsequently placing the foods thus packaged in mixed convection/steam ovens in order to cook them.

Currently, this cooking technique is used exclusively in the professional field, since due to the large space occupation and considerable complexity of use of the apparatuses required to perform it, it is practically unusable in the household field.

SUMMARY OF THE INVENTION

The aim of the present invention is to provide a valid solution to the problem described above by providing a vacuum cooking apparatus which allows to practice this cooking technique in the household field as well.

Within this aim, an object of the invention is to provide a vacuum cooking apparatus for household use which is very simple and practical to use.

Another object of the present invention is to provide a vacuum cooking apparatus for household use which is capable of giving the greatest assurances of reliability and safety in operation.

Another object of the present invention is to provide a vacuum cooking apparatus for household use which can be obtained by means of commonly commercially available elements and materials and is also competitive from a merely economical standpoint.

This aim and these and other objects, which will become better apparent hereinafter, are achieved by an apparatus for vacuum cooking for household use according to the invention, comprising, on a supporting structure which has a column-like extension, at least one unit for packaging in pouches vacuum food products to be cooked, at least one unit for cooking said food products arranged in pouches and at least one unit for quick refrigeration of said food products arranged in pouches and cooked, said at least one unit for packaging food products in pouches in vacuum comprising a vacuum packaging machine which is mounted on a drawer-like element which is supported so that it can slide by said supporting structure in order to pass from a retracted position, in which said vacuum packaging machine is arranged within the outer peripheral contour of said supporting structure, to an extracted position, in which said vacuum packaging machine is positioned at least partially outside said supporting structure, and vice versa, wherein said vacuum packaging machine comprises a base which defines a packaging chamber which is adapted to accommodate at least one pouch for the packaging of said food products, and a lid which can move with respect to said base between a closed condition and an open condition of said packaging chamber, said packaging chamber being connectable on command to a pump for creating vacuum and accommodating internally means for sealing a mouth of said at least one pouch, and wherein said lid is adapted to pass automatically from said closed condition to said open condition following the passage of said drawer-like element from said retracted position to said extracted position, and is adapted to pass from said open condition to said closed condition upon the passage of said drawer-like element from said extracted position to said retracted position.

BRIEF DESCRIPTION OF THE DRAWINGS

Further characteristics and advantages of the invention will become better apparent from the description of some preferred but not exclusive embodiments of the apparatus according to the invention, which are illustrated by way of non-limiting example in the accompanying drawings, wherein.

DESCRIPTION OF THE PREFERRED EMBODIMENTS

Figure 2:
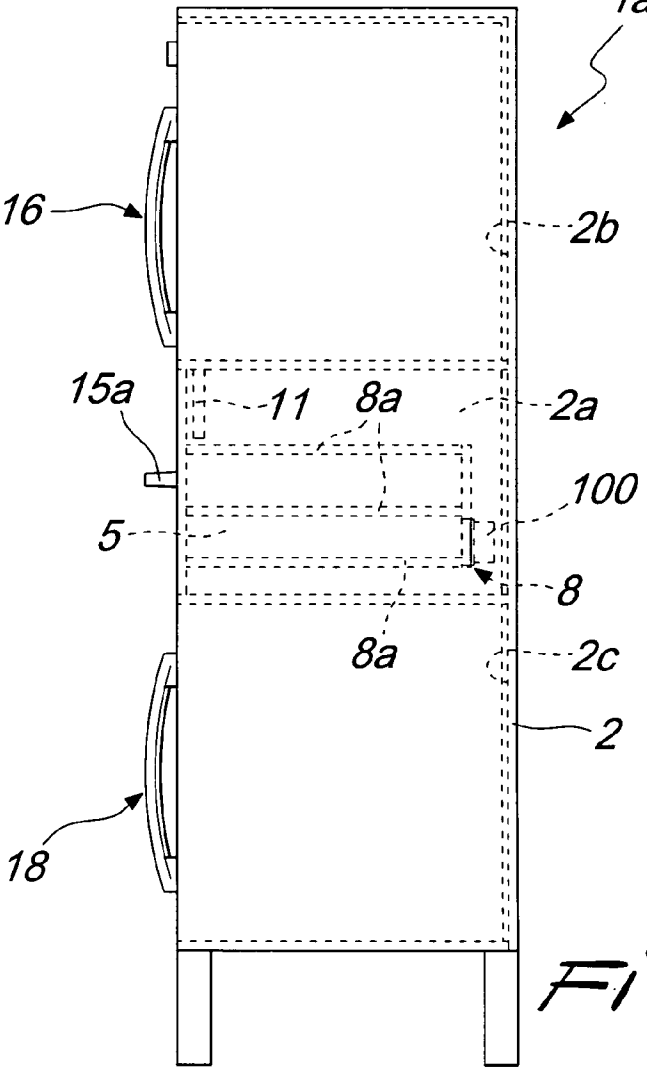
FIG. 2 is a side elevation view of the embodiment of FIG. 1 with a drawer-like element in the retracted position.

With reference to the figures, the vacuum cooking apparatus for household use, according to the invention, is generally designated by the reference numerals 1*a*, 1*b* and 1*c* in its different embodiments.

Elements and components of the apparatus according to the invention which are similar in the different embodiments described hereinafter in some cases are designated for the sake of convenience by the same reference numeral.

According to a first embodiment, shown in particular in FIGS. 1 to 4, the apparatus 1*a* comprises a supporting structure 2, which advantageously has a column-like extension so that it can be inserted easily and conveniently in a household kitchen.

According to the invention, on the supporting structure 2 there are provided at least one unit 3*a* which allows to package in vacuum pouches food products to be cooked, at least one unit 3*b* for cooking the food products placed in pouches in vacuum, and at least one unit 3*c* for performing quick refrigeration of the food products once they have been cooked in pouches in vacuum.

With this configuration, in practice it is possible to prepare, even at home, vacuum cooked foods to then preserve them in the refrigerator, after reducing their temperature so as to reduce the risks of bacterial proliferation, making them ready for consumption, after heating, with all their nutritional and organoleptic characteristics ensured by vacuum cooking, as will become better apparent hereinafter.

In greater detail, the unit 3*a* of the apparatus 1*a* is constituted conveniently by a vacuum packaging machine 4, preferably of the type which has a bell-like structure.

In particular, the vacuum packaging machine 4 comprises, as is per se known, a lower base 5 which defines a packaging chamber 6, which is designed to accommodate at least one pouch for packaging food products and can be connected on command to a vacuum pump, of any known type and not shown for the sake of simplicity, so as to allow to create vacuum inside the packaging chamber 6 and consequently also inside the pouch positioned thereat.

Preferably, the packaging chamber 6 is extended predominantly on a substantially horizontal plane and is delimited in an upward region by a lid 7, which can move, with respect to the base 5, between a closed condition, in which it engages hermetically the base 5, so as to isolate the packaging chamber 6 from the outside, and an open condition, in which it allows access from the outside to the packaging chamber 6.

As usual, inside the packaging chamber 6 sealing means are provided for sealing the mouth of the pouch, which are constituted for example by a heat-sealing bar 9, which is arranged proximate to one end of the packaging chamber 6, and are designed to close the pouch, which is typically made of heat-sealing plastic material for food use, once a vacuum has been created inside it, so as to complete the packaging of the food products.

Figure 3:
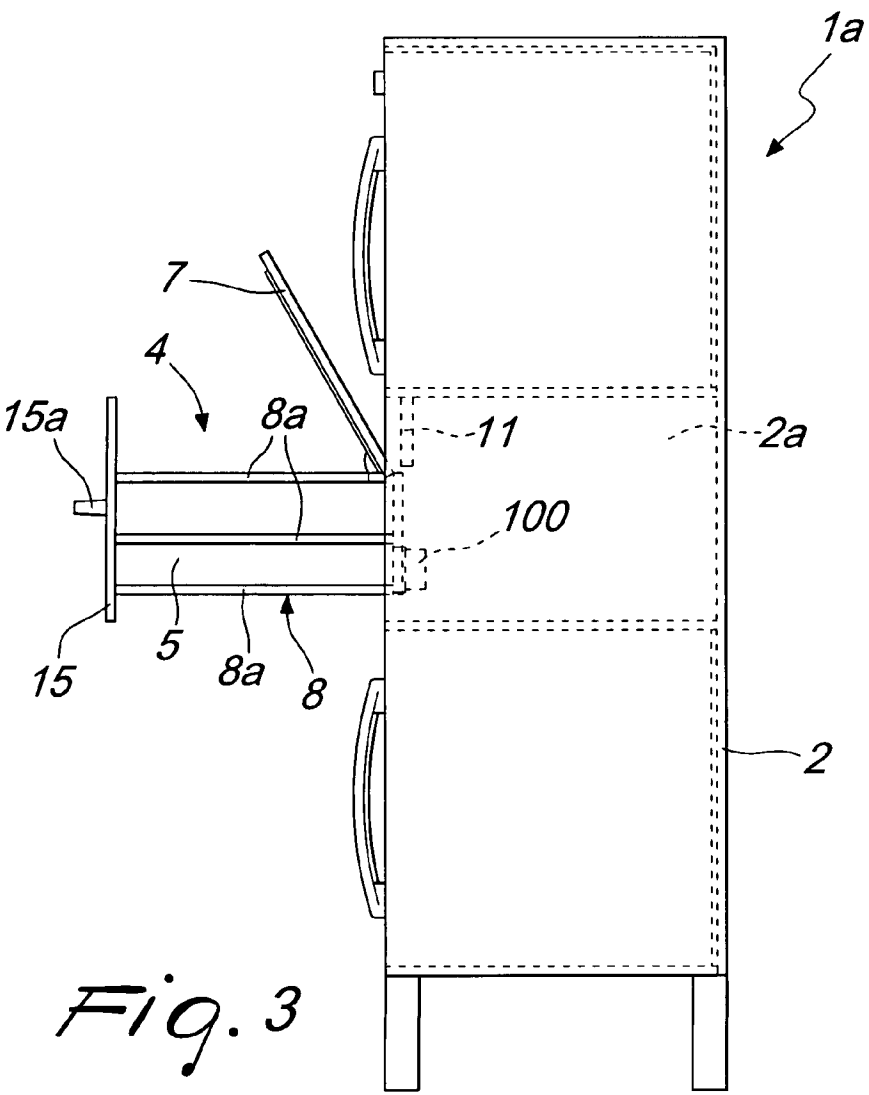
FIG. 3 is a side elevation view of the embodiment of FIG. 1 with the drawer-like element in the extracted position.

According to a peculiar aspect of the invention, the vacuum packaging machine 4 is mounted on a drawer-like element 8 slidingly supported, for example by means of lateral guiding elements 8*a*, by the supporting structure 2, so that it can pass from a retracted position, shown in FIG. 2, in which the vacuum packaging machine 4 is arranged inside the peripheral contour of the supporting structure 2, to an extracted position, shown in FIG. 3, in which the vacuum packaging machine 4 is positioned at least partially outside the supporting structure 2, in order to allow to access its packaging chamber 6.

In practice, in the supporting structure 2 there is a receptacle 2*a* for the vacuum packaging machine 4, which is open on the front side of the supporting structure 2 and accommodates slidingly the drawer-like element 8, in order to allow its passage from the extracted position to the retracted position and vice versa.

Advantageously, the lid 7 of the vacuum packaging machine 4 is adapted to pass automatically from the closed condition to the open condition as a consequence of the passage of the drawer-like element 8 from its retracted position to its extracted position, and likewise the lid 7 is also capable of passing from the open condition to the closed condition upon passage of the drawer-like element 8 from its extracted position to the retracted position.

More particularly, the lid 7 is conveniently hinged, substantially along one of its edges, to the base 5 and is connected to elastic means, which are constituted for example by a spring 10, which are designed to react against the base 5 so as to contrast the passage of the lid from its open condition to its closed condition.

More preferably, the lid 7 is hinged to the end of the base 5 that is directed toward the inside of the receptacle 2*a* and is proximate to the rear side of the drawer-like element 8, about an axis which is substantially perpendicular to the sliding direction of the drawer-like element 8, so that when the drawer-like element 8 is in the extracted position, the lid 7 can face, in its open condition, the supporting structure 2 with its outer side, arranging itself substantially on an inclined plane, as can be seen in FIG. 3.

Advantageously, in order to achieve automatic movement of the lid 7 as a consequence of the movement of the drawer-like element 8, on the supporting structure 2 there is an abutment portion 11, which is designed to engage slidingly the outer side of the lid 7 so as to cause its passage from the open condition to the closed condition, upon the passage of the drawer-like element 8 from its extracted position to its retracted position.

Conveniently, the abutment portion 11 can be provided by a border, which is arranged above the lid 7 of the vacuum packaging machine 4 and is defined in the receptacle 2*a* proximate to its open side.

In this manner, by moving the drawer-like element 8 to the extracted position, the lid 7, immediately after moving beyond the abutment portion 11, is free to assume the open condition as a consequence of the action of the spring 10. Conveniently, when instead the drawer-like element 8 is pushed from the extracted position to the retracted position, the abutment portion 11 interferes with the outer side of the lid 7 so as to cause the rotation of the lid 7 about its pivoting axis in contrast with the action of the spring 10, thus achieving the automatic passage of the lid 7 to its closed condition.

Moreover, it should be noted that due to the engagement of the abutment portion 11 against the lid 7, the lid 7 is kept locked in the closed condition, when the drawer-like element 8 is in the retracted position and the vacuum packaging machine 4 is placed inside the receptacle 2*a*.

Advantageously, the vacuum packaging machine 4 is provided with automatic actuation means, which are designed to activate automatically the vacuum pump and the sealing means of the vacuum packaging machine 4 when the drawer-like element 8 is moved from its extracted position to its retracted position.

In particular, such automatic actuation means comprise, for example, a control device which is adapted to activate the vacuum pump and the sealing means as a consequence of the passage of the lid 7 from the open condition to the closed condition of the packaging chamber 6.

Such control device is conveniently provided by a switch, which is arranged on the electric circuit for supplying power to the packaging machine 4 and more particularly to the vacuum pump and the sealing means and is provided with a button 12, which protrudes for example from the base 5 and is arranged so as to face the lid 7, so that it can be actuated by the lid 7, for example by means of a suitable engagement element 13 which is rigidly coupled to the lid 7, when the latter moves from the open condition to the closed condition.

Advantageously, the vacuum pump and the sealing means of the vacuum packaging machine 4 can also be functionally connected to control and/or monitoring means, which are conveniently arranged on a faceplate 14, which is arranged on the outer side of a front panel 15, which is fixed to the drawer-like element 8 and is provided conveniently with a handle 15*a* for manual movement of the drawer-like element 8. Such control and/or monitoring means can also comprise for example a vacuum gauge, in order to control the degree of vacuum reached in the packaging chamber 6, as well as controls of different kinds for starting and switching off the vacuum pump and the sealing means, so as to allow the user to package food products by means of the vacuum packaging machine 4 even in non-automatic operating modes.

In any case, the vacuum packaging machine is conveniently provided with a safety device which is functionally connected to the vacuum pump and to a pressure sensor which is arranged in the packaging chamber 6 and is adapted to deactivate the vacuum pump automatically when a preset vacuum level is reached in the packaging chamber 6.

In the apparatus 1*a*, the unit 3*b* designed to cook the food products inserted in pouches in the unit 3*a* is conveniently constituted by a steam oven 16, which is arranged for example in a suitably provided containment seat 2*b* defined in the supporting structure 2.

The steam oven 16 preferably comprises means for forced convection of the steam in order to achieve better cooking results.

It should be noted that conveniently such means for forced convection of the steam can be activatable or deactivatable on command by the user, so as to provide a wide range of possibilities of operation of the steam oven 16.

Programmable means for control and actuation are advantageously associated with the steam oven 16 and allow the user to set up the operation of the steam oven 16 in relation to the weight and type of the food products to be cooked.

More particularly, such programmable control and actuation means can, for example, comprise a microprocessor for processing data which is functionally connected to a controller for the heating means arranged in the steam oven 16, a memory unit which is connected to the microprocessor and stores different programs which can be selected by the user, and interfacing means 17, which are constituted for example by a display and keyboard, which are arranged on the outer side of the oven and allow the user to set, simply and intuitively, the type of food product to be cooked, for example by selecting it from a preset list provided by the memory unit, as well as the weight of the product, by entering its value on the keyboard.

Once the user has set the type of food product to be cooked and its weight, the programmable means for control and actuation of the steam oven 16 determine automatically the optimum temperature and cooking time for the type and weight of the product that is to be cooked and control, at the end of the cooking cycle, the automatic power-off of the steam oven 16.

Advantageously, in the first embodiment constituted by the apparatus 1*a*, the unit 3*c* that allows to perform quick refrigeration of the food products once they have been introduced in the pouches and cooked is constituted by a chiller 18, which is preferably accommodated within a corresponding recessed-mounting receptacle 2*c* provided in the supporting structure.

In general, the chiller 18 comprises a box-like structure 19, which defines a refrigeration chamber 20 designed to accommodate the food products that have been packaged, by means of the vacuum packaging machine 4, and cooked, by means of the steam oven 16.

The refrigeration chamber 20 is provided with temperature reduction means, which as usual are constituted by a ventilated refrigeration assembly 21, and is delimited partially by a door 22, which can be opened to allow access to the refrigeration chamber 20.

It should be noted that the ventilated refrigeration assembly 21 can be structured conveniently so that the chiller 18 can optionally operate also as a small refrigerator.

An important feature of the chiller 18 is constituted by the fact that the door 22 has at least one region 23 made of substantially transparent material in order to allow viewing from the outside of the refrigeration chamber 20 and consequently allow the user to monitor in an optimum manner the cooling process of the food products arranged in the refrigeration chamber 20.

Figure 7:
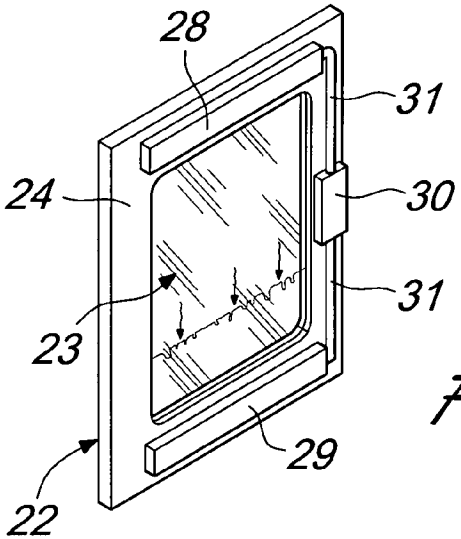
FIG. 7 is a schematic perspective view, taken from the inside, of a door of a chiller according to the invention.
Figure 8:
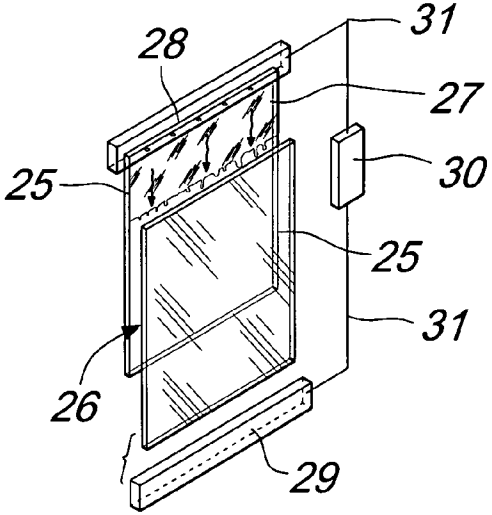
FIG. 8 is a schematic exploded view of the mist suppression means associated with the door of FIG. 7.

Conveniently, the region 23 of the door 22 is provided with mist suppression means. In greater detail, as can be seen in particular in FIGS. 7 and 8, the door 22 comprises advantageously a frame 24, which supports a pair of panes 25 made of transparent material, such as glass or the like, which are arranged so as to face each other and be spaced one another so as to define, in the space comprised between them, an interspace 26.

The peculiarity of the mist suppression means provided on the door 22 consists in that they comprise means for the circulation of a substantially transparent liquid 27, such as for example water, across the interspace 26, in order to avoid formation of condensation on the surface of the panes 25. Of course, the transparency of the liquid 27 that circulates within the interspace 26 does not prevent viewing of the refrigeration chamber through the panes 25.

Conveniently, such circulation means comprise, at one end of the interspace 26, an inlet manifold 28, which is designed to introduce the liquid 27 in the interspace 26 and is preferably provided by means of a finely perforated channel which is capable of forming a substantially continuous film of liquid 27 within the interspace 26.

It should be noted that the inlet manifold 28 is advantageously connected to the upper end of the interspace 26, so as to generate a descending current of the liquid 27 through the interspace 26.

At the opposite end of the interspace 26 there is instead an outlet manifold 29, in which the liquid 27 that has passed through the interspace 26 is collected. The outlet manifold 29 is conveniently provided by a slider collector, which is arranged in the lower part of the door 22.

Conveniently, the circulation of the liquid 27 within the interspace 26 is maintained by means of a pumping device 30 of any known type, which is preferably arranged on the inner side of the door 22 and, by means of tubes 31, is connected, by means of its intake, to the outlet manifold 29 and, by means of its delivery, to the inlet manifold 28, so as to be able to draw the liquid 27 that is collected by the outlet manifold 29 and send it to the inlet manifold 28.

It should be noted that advantageously the pumping device 30 can be activated automatically simultaneously with the activation of the means for reducing the temperature in the refrigeration chamber 20, it being in any case possible to perform its activation independently of the operation of the temperature reduction means.

It should be noted that the door 22 structured in the manner described above can be applied also to other known types of refrigeration machines, such as for example refrigerators of the household or industrial type, wine preservation cellars, refrigeration cells or display stands for supermarkets or shops for selling food products in general, and so forth.

Advantageously, the chiller 18 is further provided with programming means, which allow the user to vary the operating conditions of the chiller 18 as a function of the weight and type of the food products to be cooled.

In particular, such programming means can be constituted for example by an electronic control system which is adapted to drive the temperature reduction means arranged in the refrigeration chamber 20 and is provided with a data setup interface 32, which is arranged on an external control panel 33 of the chiller 18.

In practice, by means of the data setting interface 32, the user can select from a preset list the type of food product to be cooled, such as for example meat, fish, fruit, vegetables and so forth, and indicate its weight.

Depending on the type and weight set by the user, the electronic control system determines automatically the optimum times for quick cooling of the food product, controlling always automatically the starting and shutdown of the temperature reduction means.

It should be noted that as an alternative the chiller 18 can also be structured in any known manner.

Figure 1:
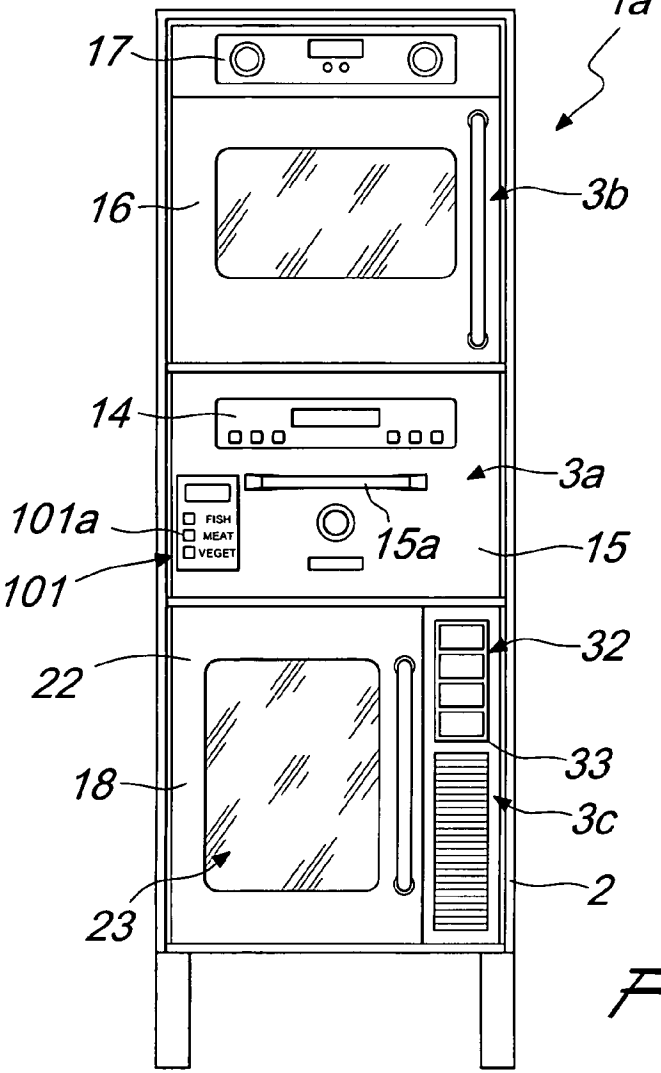
FIG. 1 is a front elevation view of the apparatus according to the invention, in a first embodiment.
Figure 4:
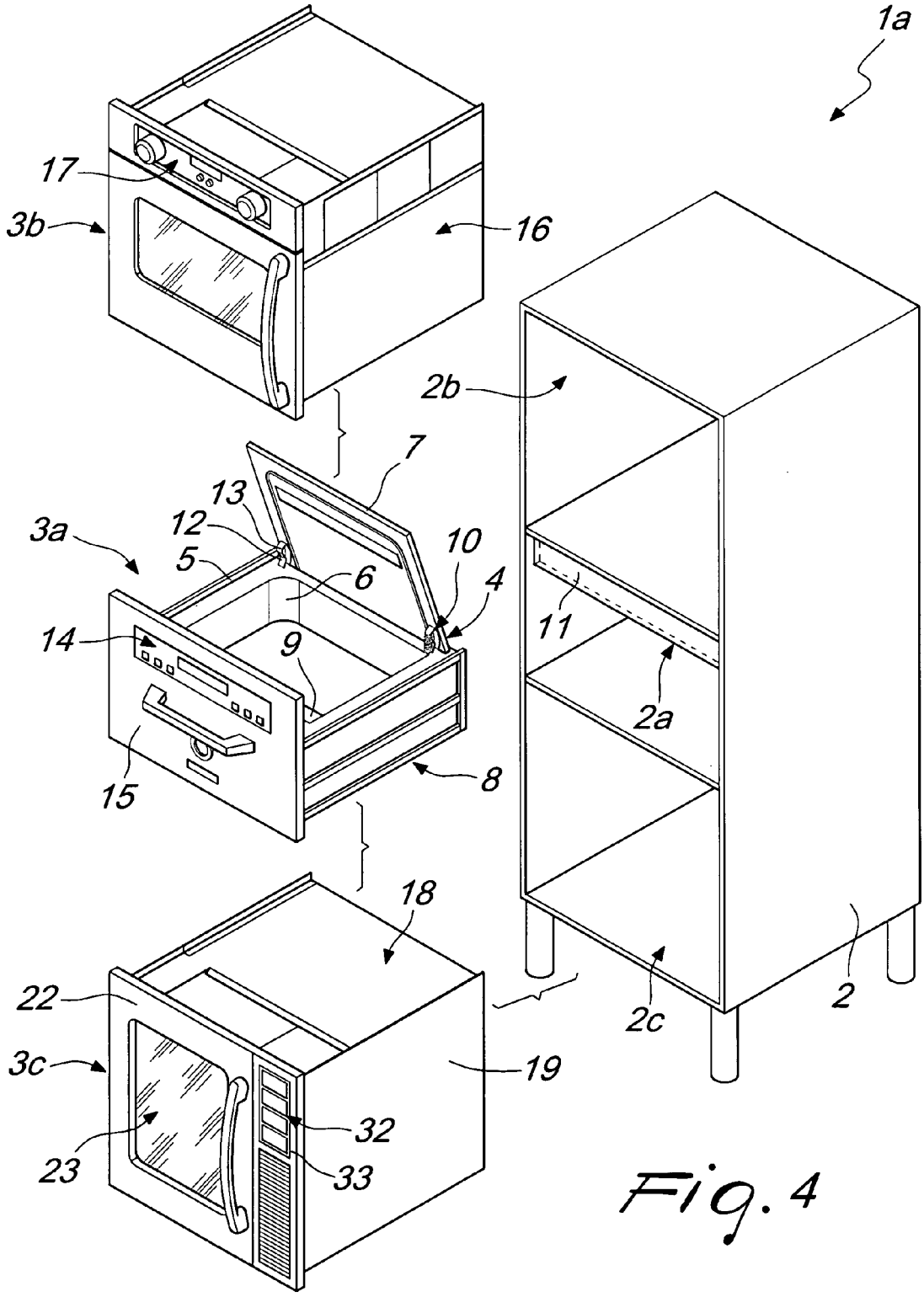
FIG. 4 is an exploded perspective view of the embodiment of FIG. 1.

As can be seen, particularly in FIGS. 1 and 4, in the apparatus 1*a* the steam oven 16, the vacuum packaging machine 4 and the chiller 18 are conveniently arranged on the supporting structure 2 so as to be superimposed along the substantially vertical direction of extension of the supporting structure 2.

Preferably, for greater convenience in use, the vacuum packaging machine 4 is arranged in the intermediate part of the supporting structure 2, while the steam oven 16 and the chiller 18 are arranged respectively in the upper part and in the lower part of the supporting structure 2.

It should be added to the above that it is conveniently possible to associate with the drawer-like element 8 weighing means 100, which allow to acquire automatically the weight of the food products introduced in pouches which are placed in the packaging chamber 6 of the vacuum packaging machine 4. Preferably, such weighing means 100 are activated when the drawer-like element 8 is in the extracted position. In particular, the weighing means 100 can be constituted for example by pressure transducers which act between the body of the drawer-like element 8 and the supporting structure 2 or by strain gauges which are associated with the surface of the drawer-like element 8 or by other suitable means of any known type. Advantageously, the weighing means 100 are connected in input to the programmable control and actuation means of the steam oven 16 and to the electronic control system of the chiller 18, so as to be able to provide them automatically with the value of the weight of the food products detected thereby.

In this case, the apparatus 1*a* can also be provided with a single data setting panel 101, which is associated both with the steam oven 16 and with the chiller 18 and by means of which the user only has to set the type of food product that he intends to cook and cool, since its weight is acquired automatically by the weighing means 100. Conveniently, the data setting panel 101 is arranged so that it can be reached easily by the user and more particularly it is arranged on the outer side of the front panel 15 of the drawer-like element 8. By way of example, the data setting panel 101 can be provided with a keypad 101*a* which allows to select the type of food product that is to be cooked and cooled.

Figure 6:
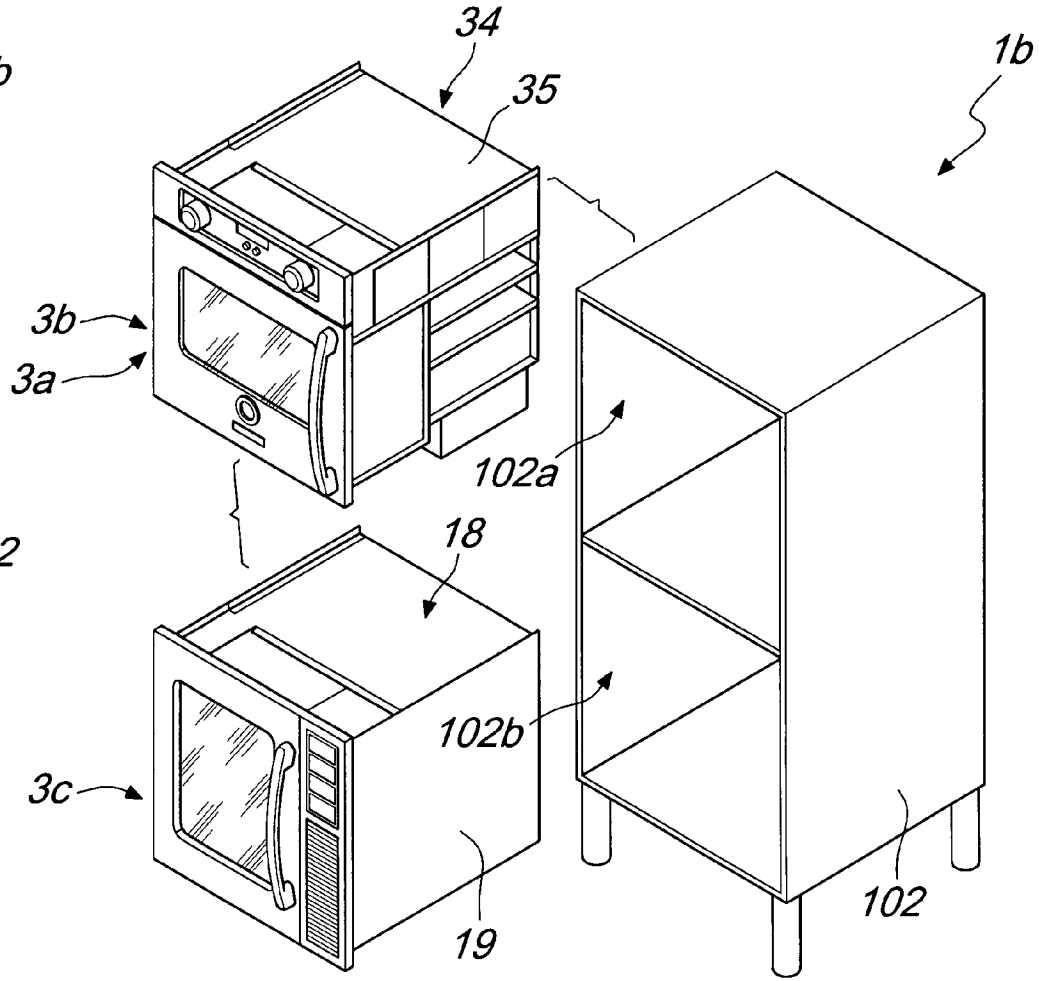
FIG. 6 is an exploded perspective view of the second embodiment of the invention.
Figure 5:
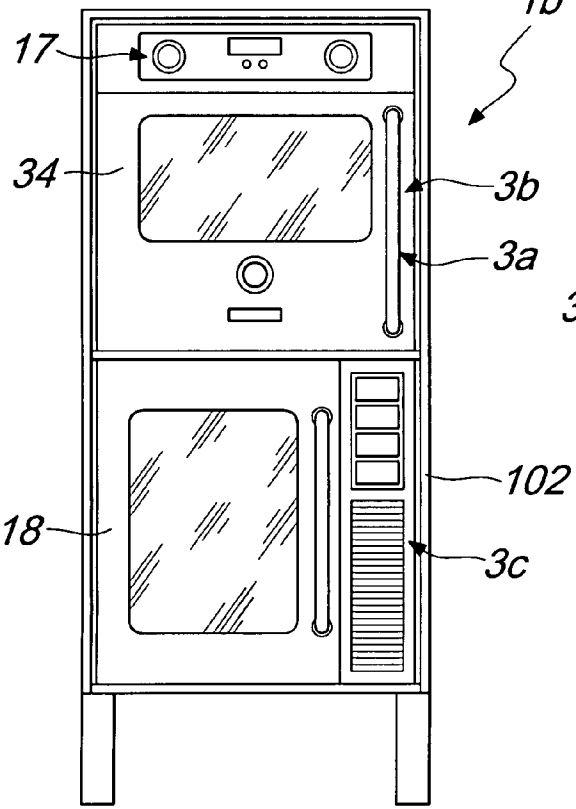
FIG. 5 is a front elevation view of the apparatus according to the invention, in a second embodiment.
Figure 9:
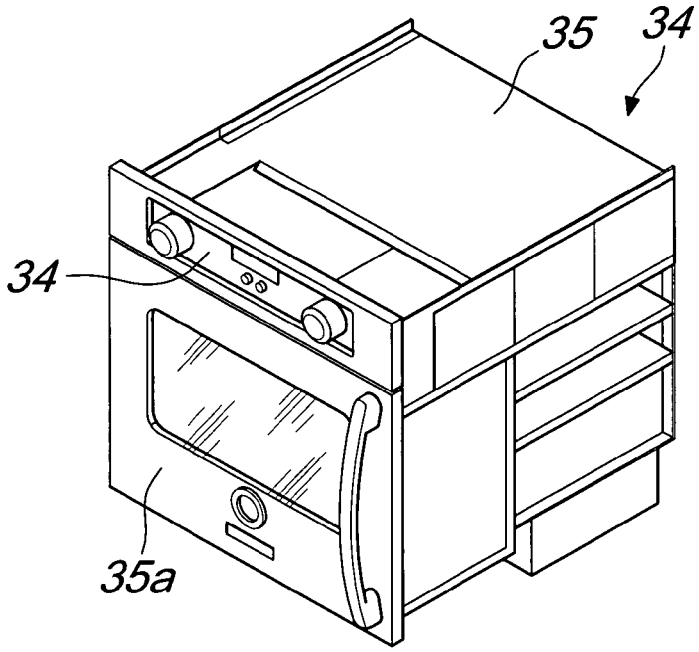
FIG. 9 is a perspective view of an apparatus for packaging and cooking food products in pouches.
Figure 10:
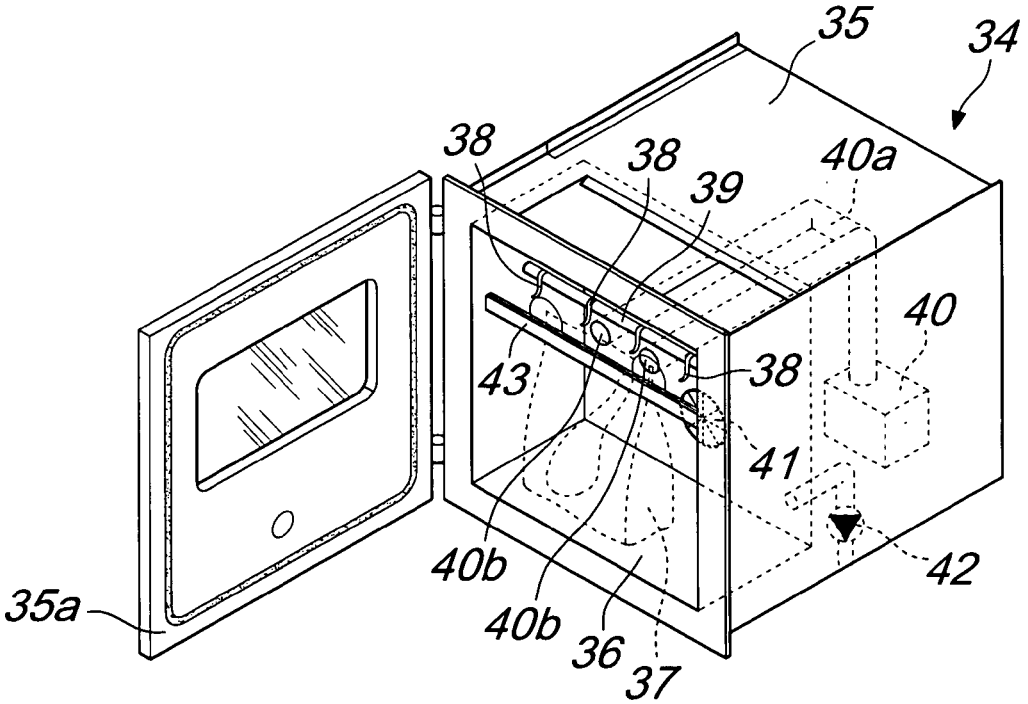
FIG. 10 is a perspective view of the apparatus of FIG. 9 with its door in the open position.

In a second embodiment of the apparatus according to the invention, designated by the reference numeral 1*b*, particularly in FIGS. 5 and 6, the unit 3*a* for packaging in pouches in vacuum the food products and the unit 3*b* for cooking the food products, once they have been introduced in the pouches, are practically integrated into a single apparatus 34, which allows both packaging and cooking of food products.

In this solution also, the unit 3*c* for performing quick refrigeration of the food products can be advantageously provided by a chiller 18, which is preferably but not necessarily of the type described above in relation to the first embodiment.

As can be seen in FIG. 5, the apparatus 34 and the chiller 18 are arranged on a supporting structure 102 which is column-shaped, as in the previously described exemplary embodiment, so as to be superimposed along a substantially vertical direction.

Conveniently, the structure 102 has suitable recesses 102*a* and 102*b* to accommodate the apparatus 34 and the chiller 18.

Advantageously, the apparatus 34 is constituted by a box-like body 35, which defines internally a packaging and cooking chamber 36, which is adapted to accommodate at least one pouch 37 with the food products to be packaged and cooked, and is closed by an access door 35*a* which can be opened. The pouch 37 can be of any known type and is preferably made of heat-sealing plastic material for food use.

The apparatus 34 is further provided with suction means, which are connected to the packaging and cooking chamber 36 in order to create at least partial vacuum in the pouch 37 accommodated in the packaging and cooking chamber 36, with means for sealing the pouch 37, which are designed to close the pouch once vacuum has been provided inside it, and with means for heating the packaging and cooking chamber 36, which allow to cook the food products packaged inside the pouch 37.

In detail, the packaging and cooking chamber 36 lies conveniently on a substantially vertical plane and has, inside it, engagement means which allow to hang the pouch 37 in the packaging and cooking chamber 36 substantially vertically, with the mouth directed upwardly. In this manner, the possible escape of the liquid seasonings from the pouch 37 is avoided.

For example, such engagement means can be constituted by a plurality of hooks 38, which are associated with the internal surface of the packaging and cooking chamber 36 and can engage holes provided in the pouch 37, substantially at its mouth.

Conveniently, the hooks 38 are mounted so that they can slide on a guide 39 which lies substantially horizontally and is arranged in the upper part of the packaging and cooking chamber 36, so as to allow to vary the mutual distance of the hooks 38 along said guide 39, depending on the dimensions of the pouch 37.

In more sophisticated alternative solutions, the engagement means can also be provided by electromagnets and/or pistons which are designed to clamp a flap of the pouch 37 against an internal wall of the packaging and cooking chamber 36 or by other equivalent elements.

Conveniently, it is possible to optionally associate with the engagement means weighing means for weighing the food products introduced in pouches.

Preferably, the means for heating the packaging and cooking chamber are constituted by means for introducing a heating fluid in the packaging and cooking chamber 36 and comprise means for the forced circulation of such heating fluid in the packaging and cooking chamber 36.

In greater detail, the heating means are provided by way of a steam generator 40, which is accommodated within the box-like body 35 and has a duct 40*a* for dispensing steam which is connected to the packaging and cooking chamber 36 through one or more inlet openings 40*b*, which are defined in an internal delimiting wall of the packaging and cooking chamber 36. Conveniently, there is also at least one fan 41, which is arranged preferably in the packaging and cooking chamber 36 and is designed to produce the forced circulation of the steam within the packaging and cooking chamber 36.

Advantageously, the suction means associated with the packaging and cooking chamber 36 are constituted by a vacuum pump 42, which is arranged inside the box-like body 35 and can be connected on command, with its intake, to the packaging and cooking chamber 36, in order to create in the packaging and cooking chamber 36 a partial vacuum which allows to extract the air from the pouch 37 through its mouth.

The sealing means can be constituted for example by a heat-sealing bar 43, which is arranged substantially horizontally in the upper part of the packaging and cooking chamber 36.

The heat-sealing bar 43 is conveniently movable on command so as to be able to move it into contact with the pouch 37 and can be heated to a preset temperature, in a per se known manner, in order to heat-seal the flaps of the mouth of the pouch 37.

Moreover, the apparatus 34 is provided advantageously with an assembly for controlling and actuating the heating means, which can be programmed as a function of the weight and type of the food products to be cooked.

In particular, the monitoring and control assembly is provided with a control panel 44, which is arranged on the outer side of the apparatus 34 and by means of which the user can set the type and weight of the food products that he wishes to cook. Depending on the type and weight selected by the user, the monitoring and control assembly therefore determines automatically, by means of an electronic processor, the optimum temperatures and cooking times for the food products and activates, according to the set temperatures and times, the heating means. Conveniently, the weight of the food products can also be acquired automatically by way of the weighing means associated with the pouch engagement means.

It should be noted that the apparatus 34 can also be used on its own on a piece of kitchen furniture, without the need to be associated with the chiller 18.

Figure 11:
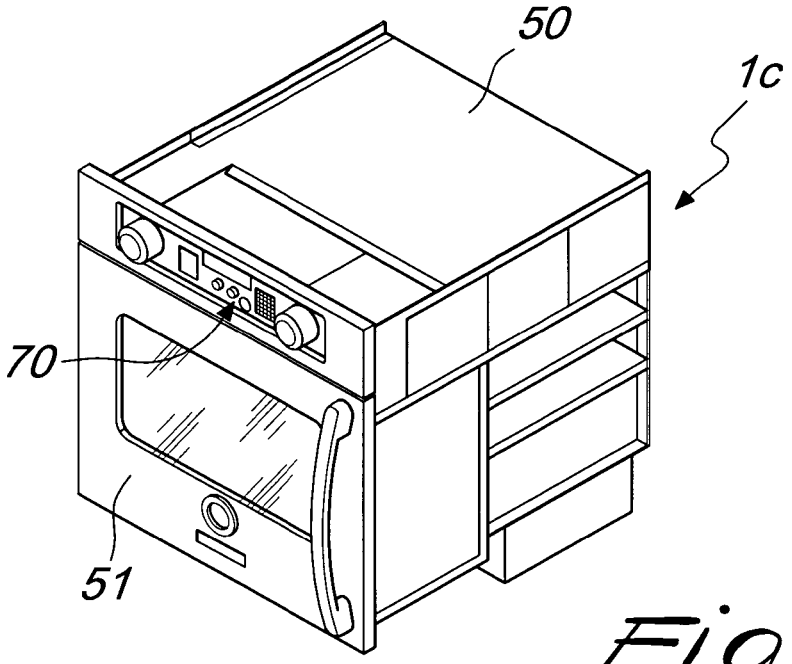
FIG. 11 is an exploded perspective view of the apparatus according to the invention, in a third embodiment.
Figure 12:
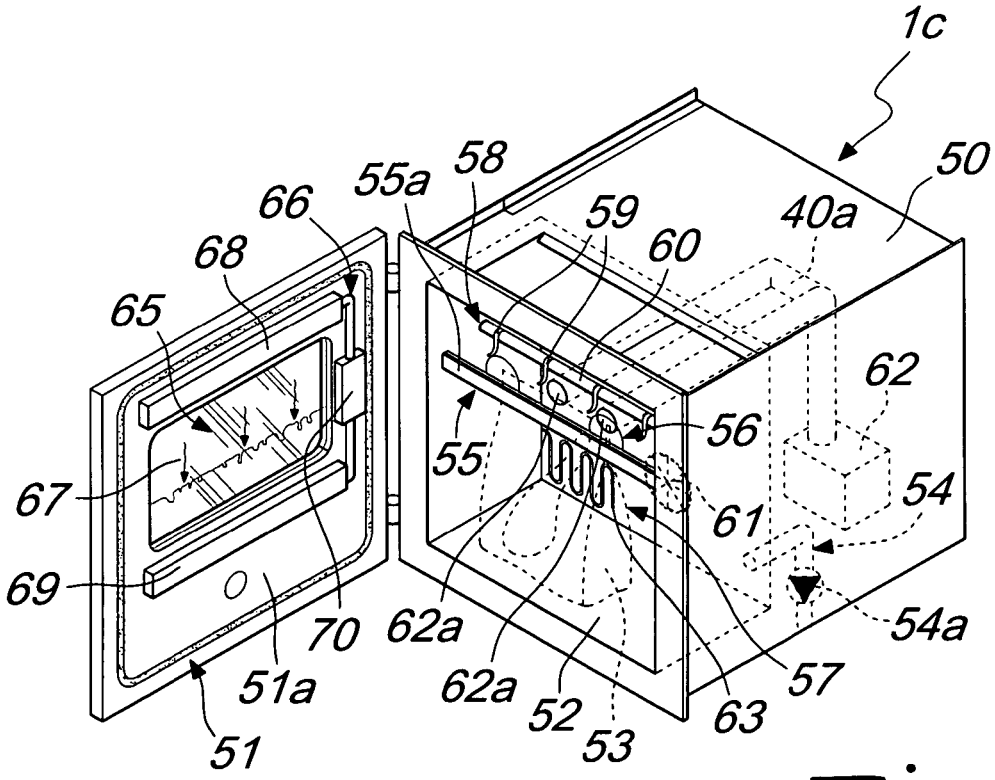
FIG. 12 is a perspective view of the embodiment of FIG. 11 with the door open to show the interior.
Figure 13:
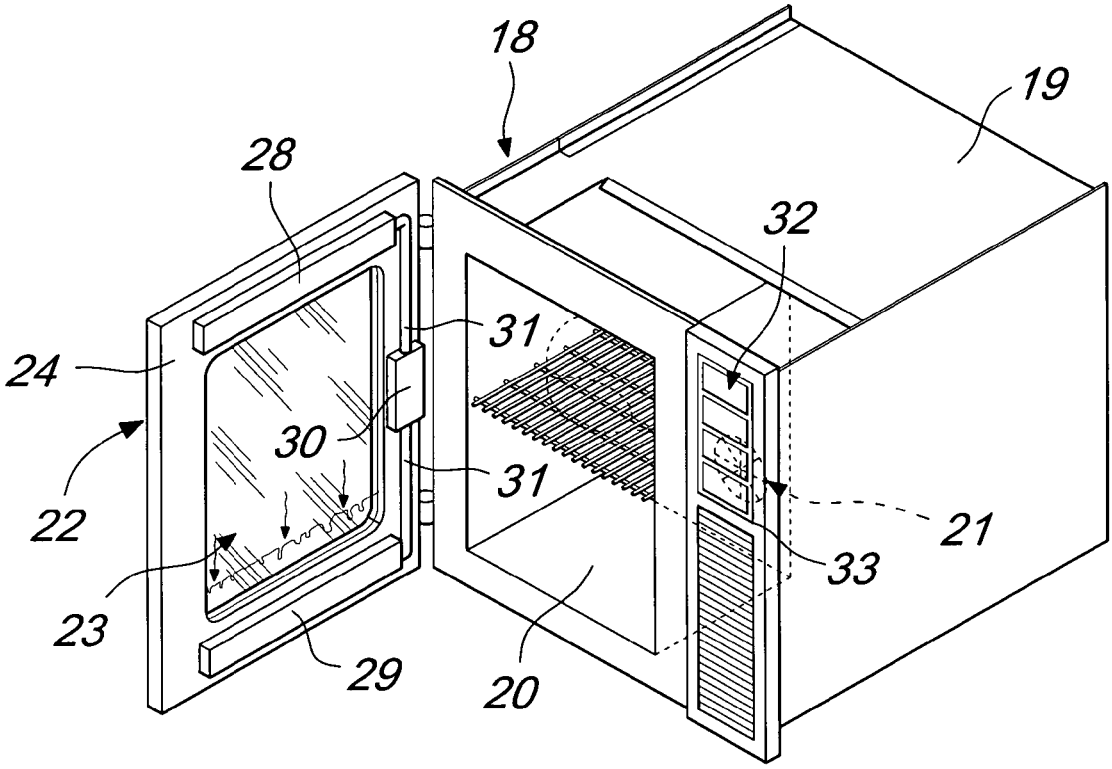
FIG. 13 is a perspective view of a chiller with its door in the open position.
Figure 14:
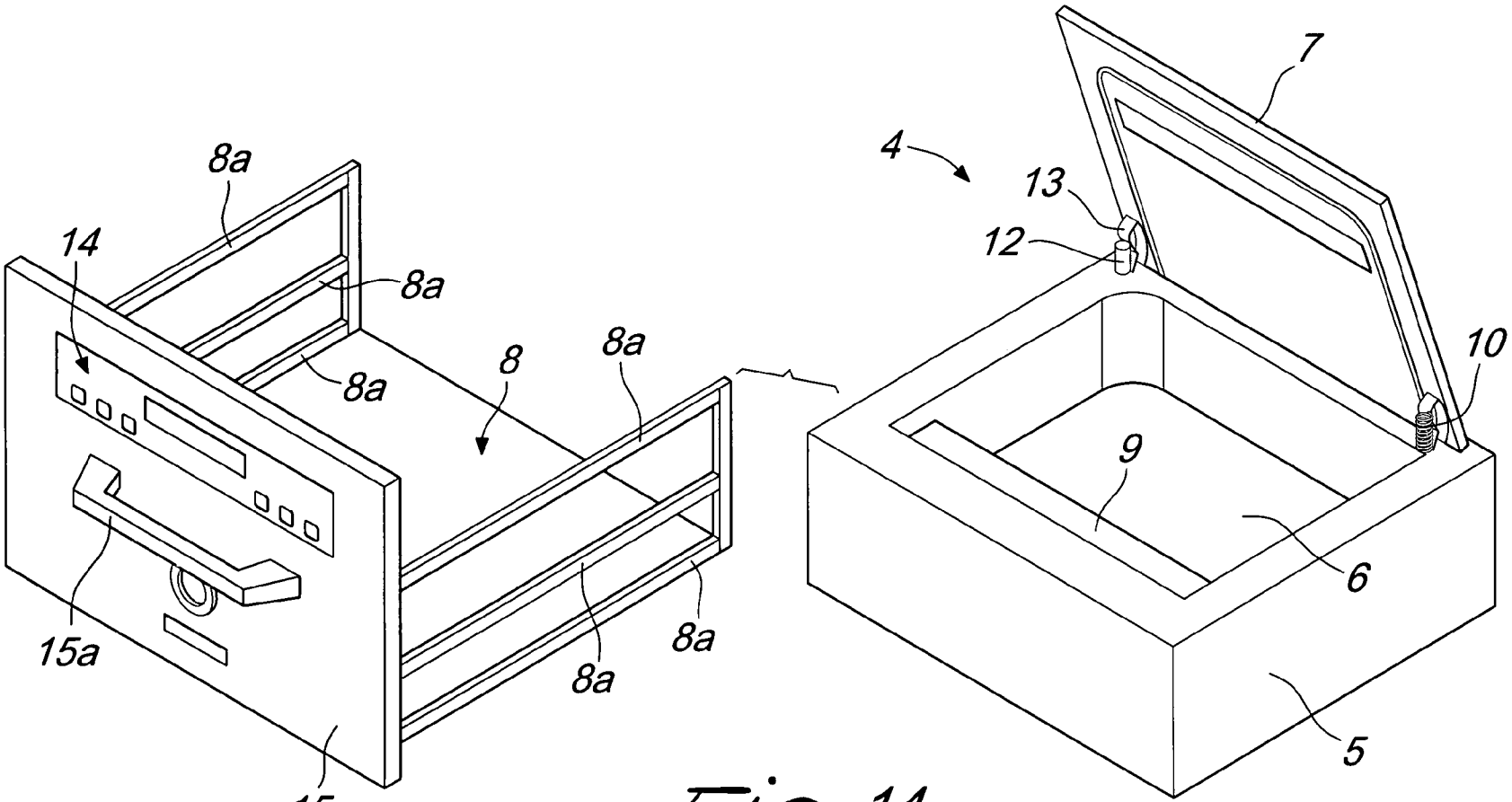
FIG. 14 is an exploded perspective view of a vacuum packaging machine and of a drawer-like element for supporting the vacuum packaging machine.

In a third embodiment, shown in FIGS. 11 and 12, the apparatus 1*c* comprises a single box-like enclosure 50, which is structured so as to allow the user to perform inside it not only the vacuum packaging of food products but also cooking and quick refrigeration thereof.

In practice, in this case, all the functions performed in the previous described embodiments by the units 3*a*, 3*b* and 3*c* are integrated in the box-like enclosure 50.

In greater detail, the box-like enclosure 50 delimits with an openable door 51*a* compartment 52, which is adapted to accommodate at least one pouch 53, of a known type and preferably of a suitable synthetic material, in which the food products to be subjected to vacuum cooking are arranged.

Suction means 54 are associated with the compartment 52 and are designed to provide vacuum inside the pouch 53 accommodated in the compartment 52 with a preset degree of vacuum.

Also inside the compartment 52 there are means 55 for sealing the pouch 53, which are designed to provide the hermetic closure of the pouch 53 once vacuum has been provided inside it.

In order to allow cooking of the food products vacuum packaged in pouches, heating means 56 are provided in the compartment 52.

An important feature of the apparatus 1*c* is that it further has, inside the compartment 52, refrigeration means 57 which allow to perform quick refrigeration of the food products, introduced in pouches and cooked, which are arranged in the compartment 52.

As shown, the compartment 52 lies conveniently on a substantially vertical plane and is provided with engagement means 58 which allow to arrange the pouch 53, within the compartment 52, so that it hangs vertically with its mouth directed upwardly, so as to prevent the possibility of escape of the liquid seasonings or of anything contained in the pouch 53.

The engagement means 58 are constituted for example by a plurality of hooks 59, which can engage holes provided in the pouch 53, substantially at its mouth, and are mounted so that they can slide along a substantially horizontal guide 60 which is fixed to the upper part of the internal surface of the compartment 52, so as to allow the user to vary the mutual distance of the hooks 59 as a function of the dimensions of the pouch 53.

As an alternative, the hooks 59 can be replaced with electromagnets and/or pistons.

Conveniently, it is optionally possible to associate with the engagement means further means for automatically detecting the weight of the food products introduced in pouches; such means can be provided for example by way of strain gauges or pressure transducers.

Advantageously, the suction means 54 of the apparatus 1*c* comprise a vacuum pump 54*a*, which is accommodated within the box-like enclosure 50 and can be connected on command, with its intake, to the inside of the compartment 52 in order to extract air from the compartment 52 and therefore also from the pouch 53.

Preferably, the heating means 56 are constituted by means for introducing a heating fluid in the compartment 52 and can conveniently have means for the forced circulation of such heating fluid inside the compartment 52, which are constituted advantageously by a fan 61 arranged on an internal wall of the compartment 52.

In particular, the means for introducing the heating fluid can comprise for example a steam generator 62, which is arranged inside the box-like enclosure 50 and can be connected on command to the inside of the compartment 52 through one or more steam supply ports 62*a* defined in the internal walls of the compartment 52.

Conveniently, the sealing means 55 can be constituted by a heat-sealing bar 55*a*, which is arranged substantially horizontally and can be moved into engagement with the pouch 53 and heated to a preset temperature, by means of electric resistors associated with it, so as to produce by contact the heat-sealing of the mouth of the pouch 53.

Advantageously, the refrigeration means 57 can be constituted by ducts 63 for the circulation of a refrigeration fluid, which are arranged in a heat-exchange relation with the compartment 52. In particular, said circulation ducts lie in thermal contact with the internal walls of the compartment 52 and belong for example to a refrigeration circuit which is accommodated within the box-like enclosure 50, of which they constitute the evaporator.

The refrigeration means 57 can also have a ventilated refrigeration assembly, of a per se known type.

As shown, the openable door 51 of the compartment 52 advantageously has at least one region 65 which is made of substantially transparent material, so as to allow to view from the outside the inside of the compartment 52.

Conveniently, in order to avoid formation of condensation, during the activation of the refrigeration means 57 of the compartment 52, on the region 65 of the openable door 51, with consequent reduction of its transparency, the region 65 is provided with mist suppression means, which can be structured for example in a manner similar to the ones described in relation to the chiller 18 and can therefore comprise, with reference to the specific example of embodiment, means 66 for circulating a substantially transparent liquid, such as for example water, through an interspace, which is defined between a pair of panes 67 made of transparent material, such as glass or the like, which are supported so as to face each other by the frame 51*a* of the openable door 51 and provide in practice the region 65.

Conveniently, the circulation means 66 comprise, at one end of the interspace formed between the panes 67, an inlet manifold 68, for introducing the liquid in the interspace, and, at the opposite end of the interspace, an outlet manifold 69 for removing the liquid from the interspace.

The inlet manifold 68 and the outlet manifold 69 are connected one another, externally with respect to the interspace, by interposing a pumping device 70, which allows to keep the liquid circulating within the interspace and can be activated automatically when the refrigeration means 57 are started or can be actuated independently of the activation of the refrigeration means 57, according to the requirements.

Advantageously, the inlet manifold 68 is connected to the upper end of the interspace, so as to create a descending current through the interspace, and is conveniently constituted by a finely perforated channel in order to allow formation, within the interspace, of a substantially continuous liquid film.

The apparatus 1*c* is further completed by monitoring and control means, which are functionally connected to the heating means 56 and/or to the refrigeration means 57 and can be programmed, by means of an interfacing panel 71, which is arranged on the outer side of the box-like enclosure 50, so as to allow the user to vary the operating conditions of the heating means 56 and/or of the refrigeration means 57, as a function of the weight and type of the food products to be cooked and/or refrigerated.

In particular, by means of the interfacing panel 71, the user can select the weight and type of the food products that he wishes to cook and/or cool rapidly. The monitoring and control means consequently activate automatically the heating means 56 and/or the refrigeration means 57 according to a preset cooking and/or cooling program. Optionally, the weight of the food products can be obtained directly by way of the means for automatic weight detection, which can be advantageously connected in input to the monitoring and control means.

Use of the apparatus according to the invention is as follows.

With the apparatus 1*a*, provided according to the first embodiment shown in FIGS. 1 to 4, in order to perform the vacuum packaging of the food products that will be subsequently cooked, the drawer-like element 8 is extracted from the supporting structure 2 by acting on the handle 15*a*, so that by losing the engagement between the lid 7 and the abutment portion 11 the lid 7 can open automatically by way of the action of the spring 10. A pouch in which the food products with the optional seasonings for cooking have been introduced beforehand is then arranged in the packaging chamber 6, taking care to position the pouch, in a per se known manner, so that its mouth lies proximate to the heat-sealing bar 9. The weighing means 100 can therefore detect autonomously the weight of the food products. At this point, the drawer-like element 8 is closed, moving it to the retracted position, achieving the automatic starting of the vacuum pump, which creates vacuum in the packaging chamber 6 in order to allow to extract air from the pouch. Once the preset maximum degree of vacuum has been reached in the packaging chamber 6, automatic activation of the heat-sealing bar 9 also occurs, providing the hermetic closure of the pouch.

At this point, the pouch with the vacuum-packaged food products is taken from the packaging chamber 6, after moving the drawer-like element 8 to the extracted position, and is arranged in the steam oven 16.

By way of the interfacing means 17 of the steam oven 16, the type and weight of the food products contained in the pouch are selected. The steam oven 16 thus set cooks the food products, determining automatically the necessary temperatures and cooking times.

Once cooking has ended, the steam oven switches off by itself, optionally warning the user by means of an acoustic signal, and the food products are then ready to be consumed once they have been extracted from the pouch.

If instead the user wishes to preserve the food products after cooking, postponing their consumption, he can arrange the pouch with the products cooked in the steam oven 16 inside the refrigeration chamber 20 of the chiller 18, so as to cool them rapidly and automatically, after setting the type and weight of the food products by using the data setting interface 32 of the chiller 18.

The food products placed in pouches can therefore be preserved in the refrigerator to be then consumed when needed after being extracted from the pouch and after optionally heating them in a microwave oven or in the steam oven 16, keeping unchanged all their nutritional and organoleptic characteristics.

Optionally, the setting of the steam oven 16 and of the chiller 18 can also be performed, with a single command, by means of the data setting panel 101, by selecting on its keypad 101*a* the type of food product that is to be cooked and cooled.

In the case of the apparatus 1*b*, in order to perform the vacuum packaging and cooking of the food products, a pouch 37 containing the food products and any seasoning for cooking is arranged in the packaging and cooking chamber 36 of the apparatus 34. In particular, the pouch 37 is hung from the hooks 38 so as to be arranged substantially vertically with its mouth directed upwardly and in the open condition.

Once the access door 35*a* of the packaging and cooking chamber has been closed, a cooking program is selected by setting the type and weight of the food products in the pouch 37 by using the control panel 44 arranged on the outer side of the apparatus 34.

Once this step has ended, the apparatus 34 starts automatically and the following components are activated in sequence: the vacuum pump 42, so as to place in partial vacuum the packaging and cooking chamber 36 and consequently extract the air inside the pouch 37, the heat-sealing bar 43, in order to seal the pouch 37 with the vacuum packaged food products, and finally the heating means, which, being driven by the monitoring and control assembly of the apparatus 34, according to the settings performed by the user, introduce steam, through the inlets 40*b*, into the packaging and cooking chamber 36, making it circulate appropriately by means of the fan 41, so as to cook the food products in the pouch 37.

Once cooking has ended, the apparatus 34 switches itself off automatically and the user can extract the pouch 37 from the packaging and cooking chamber 36 and subsequently optionally cool the food products contained therein by using the chiller 18 before placing them in a refrigerator for their preservation.

With reference to the third embodiment shown in FIGS. 11 and 12, in order to perform vacuum packaging, cooking and quick cooling of the food products, one proceeds initially by arranging the pouch 53 with the food products and any seasonings in the compartment 52 of the box-like enclosure 50, coupling it to the hooks 59 so that it is suspended vertically with its mouth directed upwardly and in the open condition.

Once the door 51 of the compartment 52 has been closed, a program for the operation of the apparatus 1*c* is set by selecting, by way of the interfacing panel 71, the weight and type of the food products in the pouch 53.

At this point, the apparatus 1*c* is started and the suction means 54 are activated automatically, providing vacuum in the compartment 52 and therefore in the pouch 53.

Once a preset degree of vacuum has been reached in the compartment 52, the sealing means 55 are actuated automatically and heat-seal the pouch 53 by means of the heat-sealing bar 55*a*.

Once the vacuum packaging of the food products in the pouch 53 has ended, the heating means 56 are activated automatically, reaching the operating condition established by the monitoring and control means according to the initial settings performed by the user on the interfacing panel 71.

Subsequently, once cooking has ended, the heating means 56 are switched off automatically and the refrigeration means 57 are activated, again automatically, performing the quick cooling of the food products placed in pouches and cooked.

At this point, the apparatus 1*c* switches off automatically, and the pouch 53 with the food products is extracted from the compartment 52 and placed in the refrigerator for its preservation.

In practice it has been found that the invention achieves, in all of its embodiments, the intended aim and objects, since it allows to provide, in a simple and practical manner, even in a household environment, all the steps for performing the vacuum cooking of food products as well as their preservation in full safety.

Another advantage of the invention which is particularly significant in a household application is that it allows to prepare, one day of the week, a number of dishes with vacuum cooking, which are preserved in the refrigerator to be consumed in the next few days, optionally after heating them in an oven or in a microwave oven, with a considerable time saving.

It is further important to note that the concept of arranging a machine for vacuum packaging on a drawer-like element which is supported slidingly by a supporting structure between an extracted position and a retracted position, with consequent automatic activation/deactivation of the machine itself, as described above, can generally have different applications, which may also be different from the one described above, and can be used for example, on kitchen furniture, even for professional use, of the type currently in use, or on furniture for shops for selling food products and so forth, regardless of the presence or not of a unit for cooking the food products inserted in pouches in vacuum and of a unit for performing quick refrigeration of the food products.

All the characteristics of the invention indicated above as advantageous, convenient or the like may also be omitted or be replaced with equivalents.

The individual characteristics presented with reference to general teachings or particular embodiments may all be present in other embodiments or can replace characteristics in these embodiments.

The invention thus conceived is susceptible of numerous modifications and variations, all of which are within the scope of the appended claims.

In practice, the materials used, so long as they are compatible with the specific use, as well as the dimensions and shapes, may be any according to requirements.

All the details may further be replaced with other technically equivalent elements.

The disclosures in Italian Patent Application no. VR2007A000080, from which this application claims priority, are incorporated herein by reference

What is claimed is:

1. An apparatus for vacuum cooking for household use, comprising, on a supporting structure which has a column-like extension, at least one unit for packaging in pouches vacuum food products to be cooked, at least one unit for cooking said food products arranged in pouches and at least one unit for quick refrigeration of said food products arranged in pouches and cooked, said at least one unit for packaging food products in pouches in vacuum comprising a vacuum packaging machine which is mounted on a drawer-like element which is supported so that it can slide by said supporting structure in order to pass from a retracted position, in which said vacuum packaging machine is arranged within the outer peripheral contour of said supporting structure, to an extracted position, in which said vacuum packaging machine is positioned at least partially outside said supporting structure, and vice versa wherein said vacuum packaging machine comprises a base which defines a packaging chamber which is adapted to accommodate at least one pouch for the packaging of said food products, and a lid which can move with respect to said base between a closed condition and an open condition of said packaging chamber, said packaging chamber being connectable on command to a pump for creating vacuum and accommodating internally means for sealing a mouth of said at least one pouch, and wherein said lid is adapted to pass automatically from said closed condition to said open condition following the passage of said drawer-like element from said retracted position to said extracted position, and is adapted to pass from said open condition to said closed condition upon the passage of said drawer-like element from said extracted position to said retracted position.

2. The apparatus according to claim 1, wherein said supporting structure has an abutment portion which engages slidingly against the outer side of said lid, upon the passage of said drawer-like element from said extracted position to said retracted position, in order to determine the passage of said lid from said open condition to said closed condition, in contrast with elastic means which are interposed between said lid and said base.

3. The apparatus according to claim 1, wherein said vacuum packaging machine comprises automatic actuation means, which are functionally connected to said pump and to said sealing means and are adapted to activate automatically said pump and said sealing means, following the passage of said drawer-like element from said extracted position to said retracted position, said automatic actuation means comprising an actuation device which is adapted to activate said pump and said sealing means following the passage of said lid from said open condition to said closed condition.

4. The apparatus according to claim 1, wherein said at least one unit for cooking said food products in pouches comprises a steam oven and in that said at least one unit for quick refrigeration comprises a chiller, said steam oven, said vacuum packaging machine and said chiller being arranged on said supporting structure so as to be mutually superimposed along a substantially vertical direction.

5. The apparatus according to claim 4, comprising a single data setting panel, which is arranged on said supporting structure and is functionally connected to said steam oven and to said chiller, in order to allow setting of the type of food product to be cooked and cooled.

6. The apparatus according to claim 1, wherein weighing means are associated with said drawer-like element and are adapted to weigh the food products in pouches rested within said packaging chamber.

7. The apparatus according to claim 1, wherein said at least one unit for vacuum packaging in pouches and said at least one unit for cooking said food products are integrated in a single apparatus for packaging and cooking said food products in pouches, which comprises a box-like body which defines a packaging and cooking chamber which is adapted to accommodate at least one pouch which contains food products to be packaged and cooked and has suction means which are adapted to create at least partial vacuum in said pouch accommodated in said packaging and cooking chamber, means for sealing said pouch and means for heating said packaging and cooking chamber to cook the food products in said pouch, said packaging and cooking chamber being extended on a substantially vertical plane, engagement means being provided in said packaging and cooking chamber in order to hang said pouch substantially vertically with its mouth directed upwardly, said heating means comprising means for introducing a heating fluid within said packaging and cooking chamber.

8. A vacuum cooking apparatus for household use, comprising, in a box-like enclosure, a compartment adapted to accommodate at least one pouch for packaging food products, suction means which can be connected to the inside of said pouch accommodated in said compartment and are adapted to generate at least partial vacuum in said pouch, means for sealing said pouch, means for heating said compartment in order to cook the food products contained in said pouch, and refrigeration means adapted to perform quick cooling of said compartment, said compartment being arranged on a substantially vertical plane and containing means for engaging said pouch in order to arrange said pouch so that it hangs vertically with its mouth directed upwardly.

9. The apparatus according to claim 8, wherein said compartment is closed by a door which can be opened and has at least one region made of substantially transparent material in order to allow to view said compartment from the outside, said region made of substantially transparent material being provided with mist suppression means.

10. The apparatus according to claim 8, comprising monitoring and control means which are functionally connected to said heating means and/or to said refrigeration means, said monitoring and control means being programmable as a function of the weight and type of the food products to be cooked and/or refrigerated.

11. A machine for vacuum packaging, comprising a base, which defines a packaging chamber which is adapted to accommodate at least one pouch for packaging said food products, a lid which can move with respect to said base between a closed condition and an open condition of said packaging chamber, a pump which can be connected on command to said packaging chamber to create vacuum, said packaging chamber containing means for sealing the mouth of said pouch, wherein it is fitted, with said base, on a drawer-like element which is supported so that it can slide by a supporting structure in order to pass from a retracted position, in which said vacuum packaging machine is arranged inside the outer peripheral contour of said supporting structure, to an extracted position, in which said vacuum packaging machine is positioned at least partially outside said supporting structure, and vice versa, wherein said lid is adapted to pass automatically from said closed condition to said open condition as a consequence of the passage of said drawer-like element from said retracted position to said extracted position, and is adapted to pass from said open condition to said closure condition upon the passage of said drawer-like element from said extracted position to said retracted position.

12. The machine according to claim 11, comprising automatic actuation means, which are fractionally connected to said pump and to said sealing means and are adapted to activate automatically said pump and said sealing means as a consequence of the passage of said drawer-like element from said extracted position to said retracted position.

13. An apparatus for vacuum cooking for household use, comprising, on a supporting structure which has a column-like extension, at least one unit for packaging in pouches vacuum food products to be cooked, at least one unit for cooking said food products arranged in pouches and at least one unit for quick refrigeration of said food products arranged in pouches and cooked, said at least one unit for packaging food products in pouches in vacuum comprising a vacuum packaging machine which is mounted on a drawer-like element which is supported so that it can slide by said supporting structure in order to pass from a retracted position, in which said vacuum packaging machine is arranged within the outer peripheral contour of said supporting structure, to an extracted position, in which said vacuum packaging machine is positioned at least partially outside said supporting structure, and vice versa, wherein said at least one unit for vacuum packaging in pouches and said at least one unit for cooking said food products are integrated in a single apparatus for packaging and cooking said food products in pouches, which comprises a box-like body which defines a packaging and cooking chamber which is adapted to accommodate at least one pouch which contains food products to be packaged and cooked and has suction means which are adapted to create at least partial vacuum in said pouch accommodated in said packaging and cooking chamber, means for sealing said pouch and means for heating said packaging and cooking chamber to cook the food products in said pouch, said packaging and cooking chamber being extended on a substantially vertical plane, engagement means being provided in said packaging and cooking chamber in order to hang said pouch substantially vertically with its mouth directed upwardly, said heating means comprising means for introducing a heating fluid within said packaging and cooking chamber.

* * * * *